US006481683B1

(12) United States Patent
Stewart et al.

(10) Patent No.: US 6,481,683 B1
(45) Date of Patent: Nov. 19, 2002

(54) ARTICULATING KEYBOARD SUPPORT MECHANISM

(75) Inventors: Kristin M. Stewart, Redondo Beach, CA (US); Eduardo Acúna, Paramount, CA (US); Robson L. Splane, Jr., Granada Hills, CA (US); John A. Drusch, Escondido, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 31 days.

(21) Appl. No.: 09/590,306

(22) Filed: Jun. 7, 2000

Related U.S. Application Data

(60) Provisional application No. 60/137,890, filed on Jun. 7, 1999.

(51) Int. Cl.[7] ..... A47F 5/00

(52) U.S. Cl. ..... 248/289.11; 248/288.31; 248/918; 248/919; 248/920; 211/94; 108/50.01; 108/93

(58) Field of Search ..... 248/160, 276.1, 248/274.1, 288.31, 288.51, 918, 118, 118.3, 118.5, 346.01, 284.1, 286.1, 919, 920, 921; 211/94; 108/50.01, 50.02, 93, 138

(56) References Cited

U.S. PATENT DOCUMENTS

| | | | | | |
|---|---|---|---|---|---|
| 4,708,312 | A | | 11/1987 | Rohr | 248/280.1 |
| 4,949,927 | A | | 8/1990 | Madocks et al. | 248/276 |
| 5,211,367 | A | * | 5/1993 | Musculus | 248/279 |
| 5,419,613 | A | | 5/1995 | Wedeking | 297/217.1 |
| 5,503,086 | A | * | 4/1996 | Hoffman et al. | 108/138 |
| 5,662,300 | A | | 9/1997 | Michelson | 248/279.1 |
| 5,673,628 | A | * | 10/1997 | Boos | 108/44 |
| 5,683,064 | A | | 11/1997 | Copeland et al. | 248/278.1 |
| 5,762,306 | A | | 6/1998 | Day | 248/274.1 |
| 5,775,657 | A | | 7/1998 | Hung | 248/289.11 |
| 6,082,692 | A | | 7/2000 | Price | 248/278.1 |
| 6,134,103 | A | * | 10/2000 | Ghanma | 361/681 |
| 6,227,508 | B1 | * | 5/2001 | Panzarella et al. | 248/276.1 |

* cited by examiner

*Primary Examiner*—Kimberly Wood
(74) *Attorney, Agent, or Firm*—Christie, Parker & Hale, LLP

(57) ABSTRACT

In articulating keyboard support mechanism, a plurality of cylindrical links provide for a multipositional support arm. The links are attached to the inner side of a desk using a mounting bracket and base cylinder. A keyboard support tray is coupled to the forwardmost link of the articulating arm. The tensioning bar allows for placing the links under tension so as to maintain their position.

22 Claims, 14 Drawing Sheets

43b
41
51
45
43a
49b
47b
47a
49a

ARTICULATING KEYBOARD SUPPORT MECHANISM

This application claims the benefit of U.S. Provisional Patent Application No. 60/137,890, filed Jun. 7, 1999, the disclosure of which is incorporated by reference herein.

BACKGROUND OF THE INVENTION

The present invention relates generally to support arms, and more particularly to a support arm for a keyboard tray.

The use of personal computers is widespread both at the office and at home. Such widespread use of personal computers has presented challenges to furniture and furniture accessory designers and manufacturers. A primary challenge is that office and office type furniture must be adapted to meet the requirements imposed by such computer systems.

Computer systems require room for display monitors, computer units, and computer keyboards. Display monitors are often placed on a desktop surface. Likewise, computer units are often placed about the desk on the floor or in some other position. Computer keyboards, however, often pose special problems. Preferably, a keyboard is located slightly in front of a display monitor so that a user may easily type on the keyboard while examining the monitor. Thus, users often place keyboards on desk tops directly in front of a monitor. Placing the keyboard on the desktop, however, is often troublesome. Such placement of the keyboard takes up valuable desk space which the user may at times require for other purposes. In addition, desktops are often slightly higher than the height at which ergonomic typing preferably occurs.

Extendably mounting the keyboard underneath a desktop surface, therefore, is often done. Mounting the keyboard under the desktop frees up valuable desk space, as well as positions the keyboard at a height more conducive for typing. Unfortunately, many keyboard trays extend significantly below the desktop such that the keyboard and a tray holding the keyboard reduce the knee space available for a user. Further, easy yet simple methods of positioning many keyboards, both in terms of amount of extension and of angle of inclination of the keyboard, are often lacking.

SUMMARY OF THE INVENTION

The present invention therefore provides an articulating keyboard tray support arm. In one embodiment, a keyboard tray support device comprises a bracket adapted for mounting to an underside of a desktop. An arm comprised of a plurality of links has a first end coupled to the bracket and a second end coupled to a keyboard tray. The arm is comprised of a plurality of links. The keyboard tray support device includes means to increase the friction between adjacent links so as to substantially fix position of adjacent links with respect to each other.

In one embodiment means to increase friction between adjacent links is a cable coupled to a first link at a first point and a second link at a second point, with means to increase the distance between the first point and the second point. In one embodiment this means is a camming mechanism.

In one embodiment an articulating keyboard support includes adjacent links forming an articulating arm wherein adjacent links in the series of links may be moved in directions independent of the direction and movement of other links in the series.

In yet further embodiments the keyboard tray support device is mounted using slides to an underside of a desktop surface, thereby allowing the keyboard arm to be moved with respect to the underside of the desk surface. In addition in a further embodiment the mounting to the slides is done in a rotatable manner such that the articulating arm may be rotated with respect to the slides.

Many of the attendant features of this invention will be more readily appreciated as the same becomes better understood by reference to the following detailed description considered in connection with the accompanying drawings in which like reference symbols designate like parts throughout.

DETAILED DESCRIPTION

Figure 1:
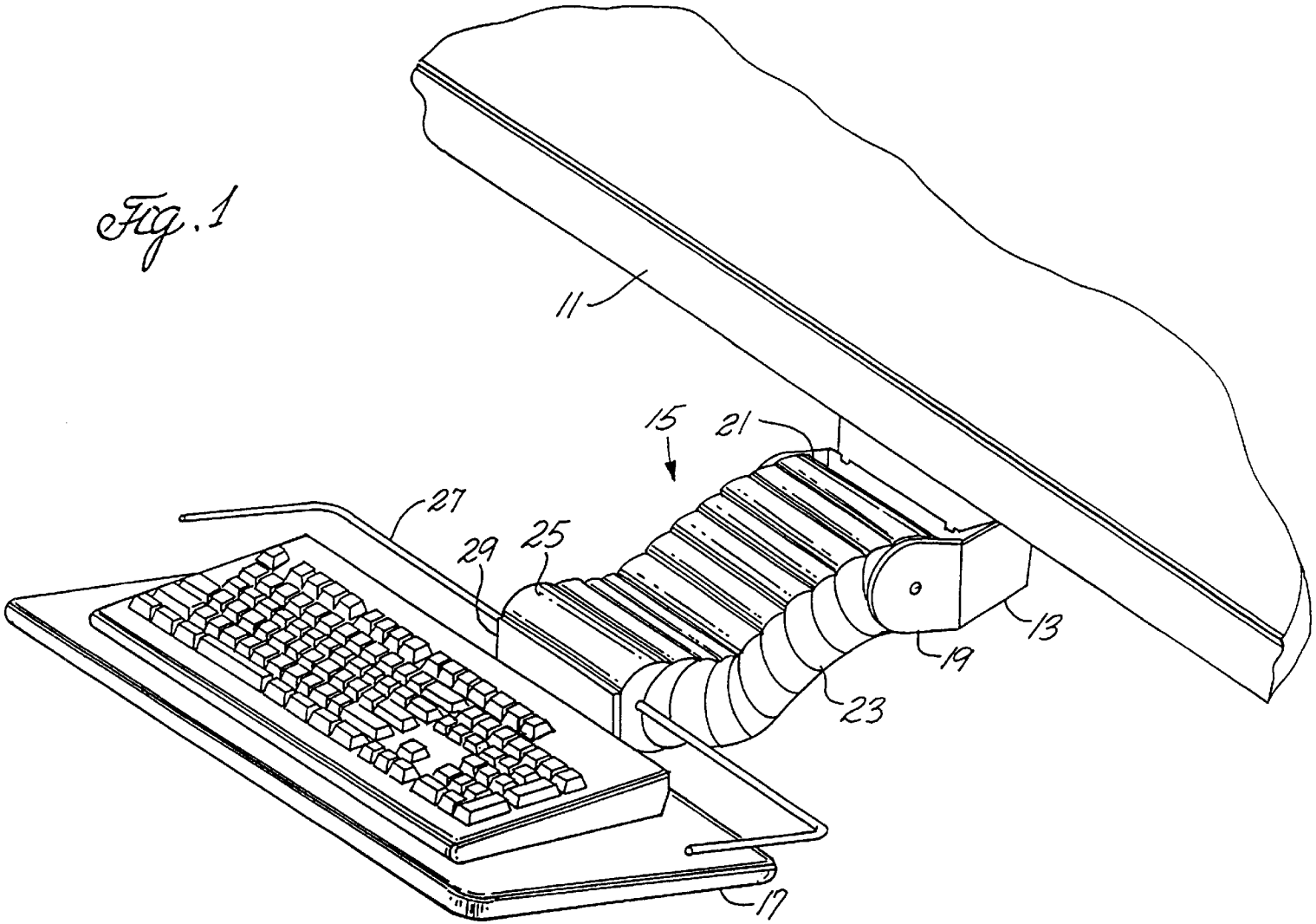
FIG. 1 illustrates a perspective view of an articulating keyboard support of the present invention.

FIG. 1 illustrates a keyboard support mechanism of the present invention. The keyboard support mechanism includes a keyboard tray 17. The keyboard tray is coupled to an articulating arm 15. The articulating arm, in turn, is coupled to a mounting bracket 13 attached to the underside of a desk 11.

The mounting bracket 13 includes opposing arms 19. Mounted between the opposing arms is a base cylinder 21. Ends of the base cylinder are coupled to the opposing arms of the mounting bracket using end caps (not shown).

Mounted to the side of the base cylinder is a series of partial cylinders 23 with cylindrical cutouts. The partial cylinders form links in the articulating arm. Coupled to the last of the partial cylinders in the series is an end piece 25. The base cylinder, the series of partial cylinders with cylindrical cutouts, each of which is mounted to a previous partial cylinder in the series, and the end piece form the articulating arm.

The end piece is also largely a partial cylinder with a cylindrical cutout. The end piece, however, includes a locking arm 27 extending from the cylindrical ends of the end piece. The end piece additionally includes an L-bracket 29 mounted along the length of the cylinder. Mounted to the L-bracket is a keyboard support tray 17.

Thus, the support tray is adjustably mounted to the underside of a desk surface by way of the articulating support arm 15 and a mounting bracket 13. Through rotation of the partial cylinders with adjacent partial cylinders, as well as the end piece and the base cylinder, the keyboard tray may be positioned at a variety of angles and positions both in the vertical and horizontal directions.

Figure 2:
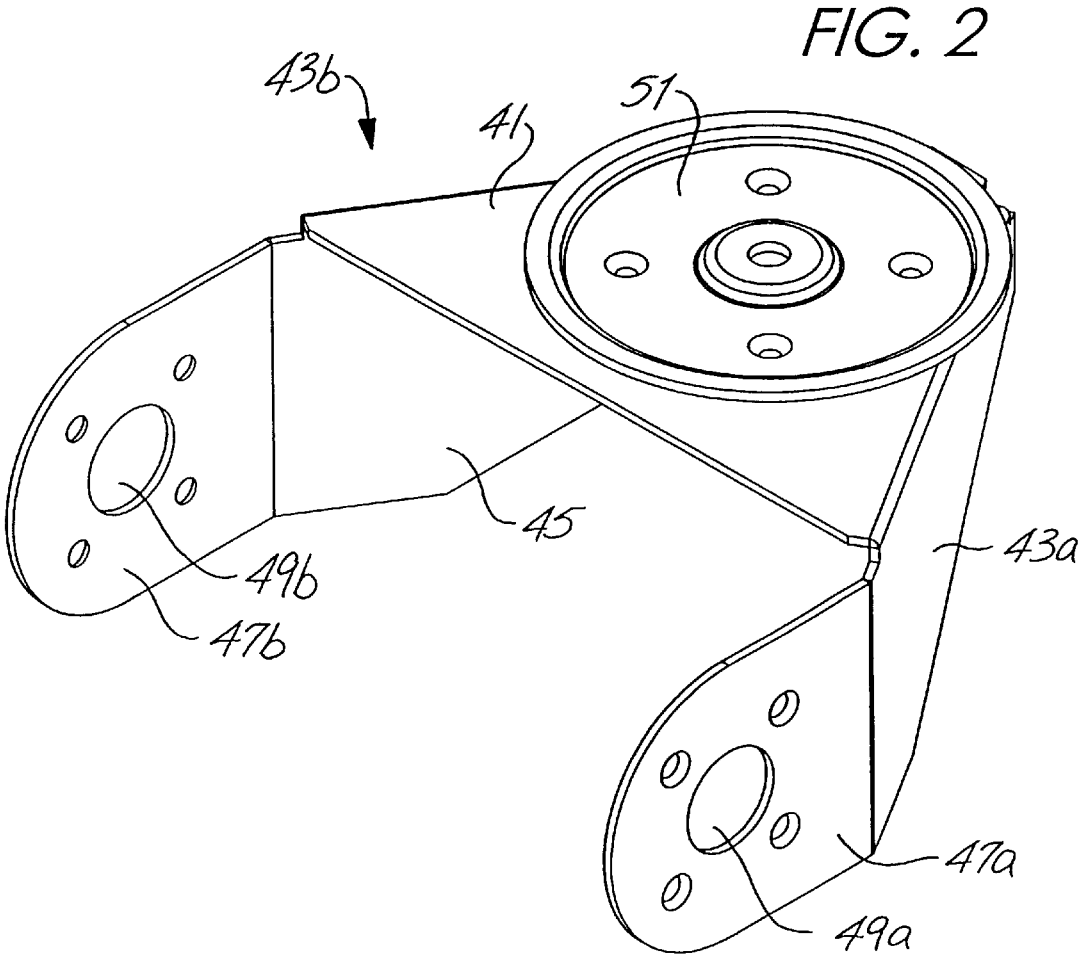
FIG. 2 illustrates a mounting bracket of the keyboard support mechanism of FIG. 1.

FIG. 2 illustrates details of the mounting bracket. The mounting bracket includes a top plate 41. The top plate forms a parallelogram with a forward edge having a greater length than a rearward edge, and connecting edges therebetween. Descending from the connecting edges of top plate are side plates 43*a*, 43*b*. Extending forward of the forward edge from, and intersecting, the side edges, are opposing arms 47*a,b*. The opposing arms are substantially parallel to one another, and have rounded semicircular forward edges. Approximate the midpoint of the semicircular forward edges are mounting holes 49*a,b*.

Affixed to the top plate is a mounting disk 51. The mounting disk 51 is substantially circular in shape and includes a raised rim along its outer edge. Further details of the mounting disk are described in the United States Patent Application entitled Extendable Swivel Mounting Bracket, application Ser. No. 09/327,208, filed Jun. 7, 1999 and commonly assigned with the present application, the disclosure of which is incorporated herein by reference.

The disk with the raised rim is slidably positioned in a disk mounting bracket mounted to the underside of the desk. In one embodiment, the mounting bracket includes a slide mechanism so as to allow placement of the keyboard tray underneath the desk top surface when not in use. When use of the keyboard is desired the mounting bracket is extendably slidable into a working position forward of the desk top surface. In addition, the disk and disk mounting bracket allows for rotation of the articulating arm with respect to the disk mounting bracket, and thus the disk. Further, the disk and disk mounting bracket increases the ease of installation of the keyboard support mechanism by allowing the mounting bracket to be installed to the underside of the desk without the weight or leverage of the articulating arm causing difficulties.

In alternative embodiments, however, the mounting bracket is merely a bracket adapted to be mounted directly to the underside of a desktop, or to a casing so mounted.

Figure 3:
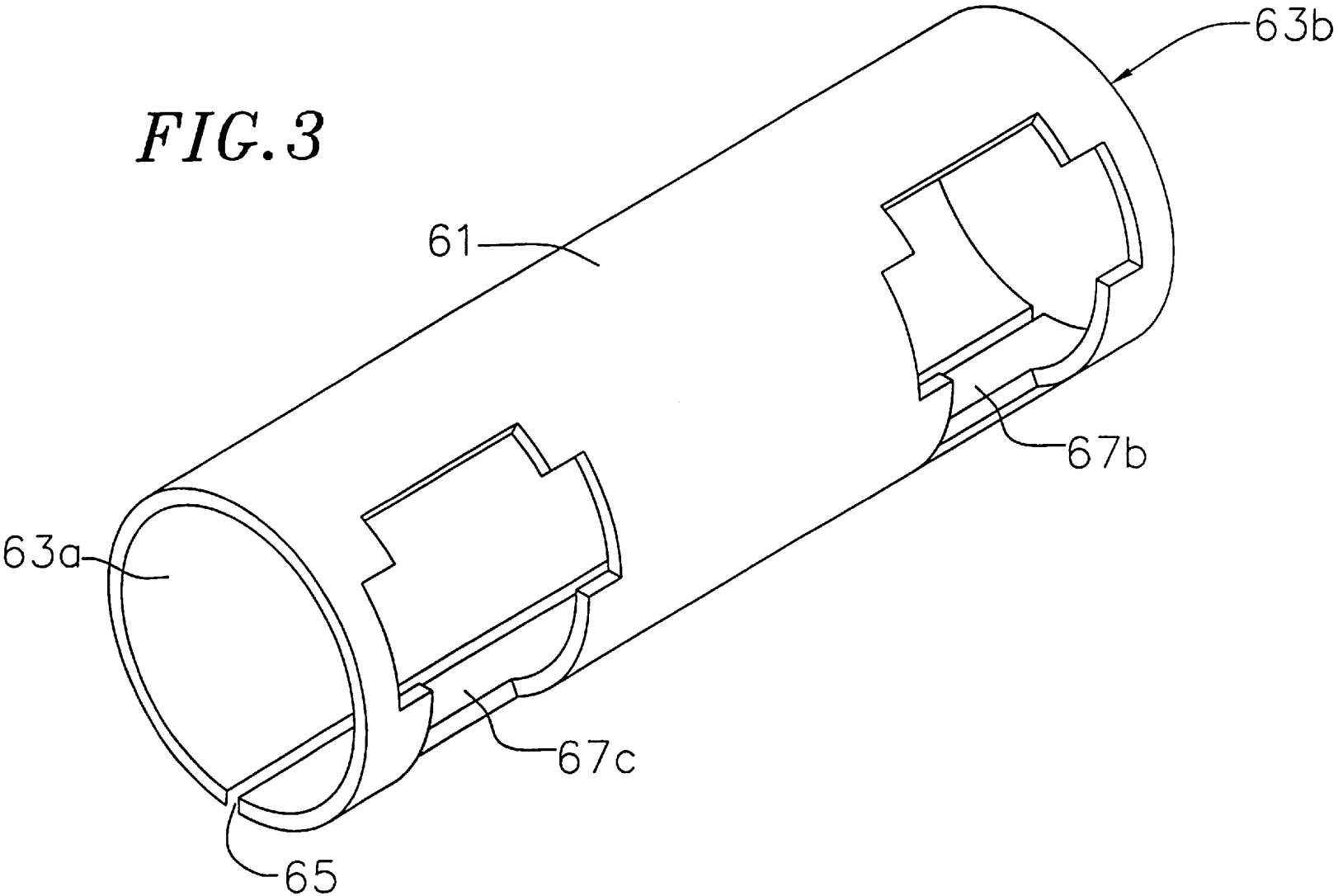
FIG. 3 illustrates a perspective view of a base cylinder of the articulating keyboard support mechanism of FIG. 1.

Returning now to FIG. 1, the base cylinder is mounted between the opposing arms. The base cylinder is illustrated in perspective view in FIG. 3. The base cylinder comprises a hollow cylindrical tube 61 with open ends 63*a,b*. Extending lengthwise along the tube is a slot 65. The slot allows the tube to decrease slightly in diameter by causing the slot to decrease in width when pressure is applied to the exterior of the tube. Along one side of the tube are cross-shaped openings 67*a,b*. The cross-shaped openings are symmetrically placed around a center line of the tube. The purpose of the cross-shaped openings is to provide access by portions of the partial cylinder coupled to the base.

The open ends of the tube are adapted to receive circular end caps. The caps have an outer diameter sufficient to cover the open ends. Approximate the center of the caps are apertures to allow the caps to be mounted to the opposing arms. The caps also have an inset portion which extends, when the caps are mounted to the open ends, within the tube. The inset portions have a fixed diameter. Accordingly, as the exterior of the base cylinder is compressed the effective diameter of the base cylinder decreases as the slot narrows. This causes a frictional grip against the inset portion of the caps, which effectively serve as brake shoes. As the caps are fixed to the opposing arms, this causes the base cylinder to be fixed in position with respect to the opposing arms of the mounting bracket.

Figure 4:
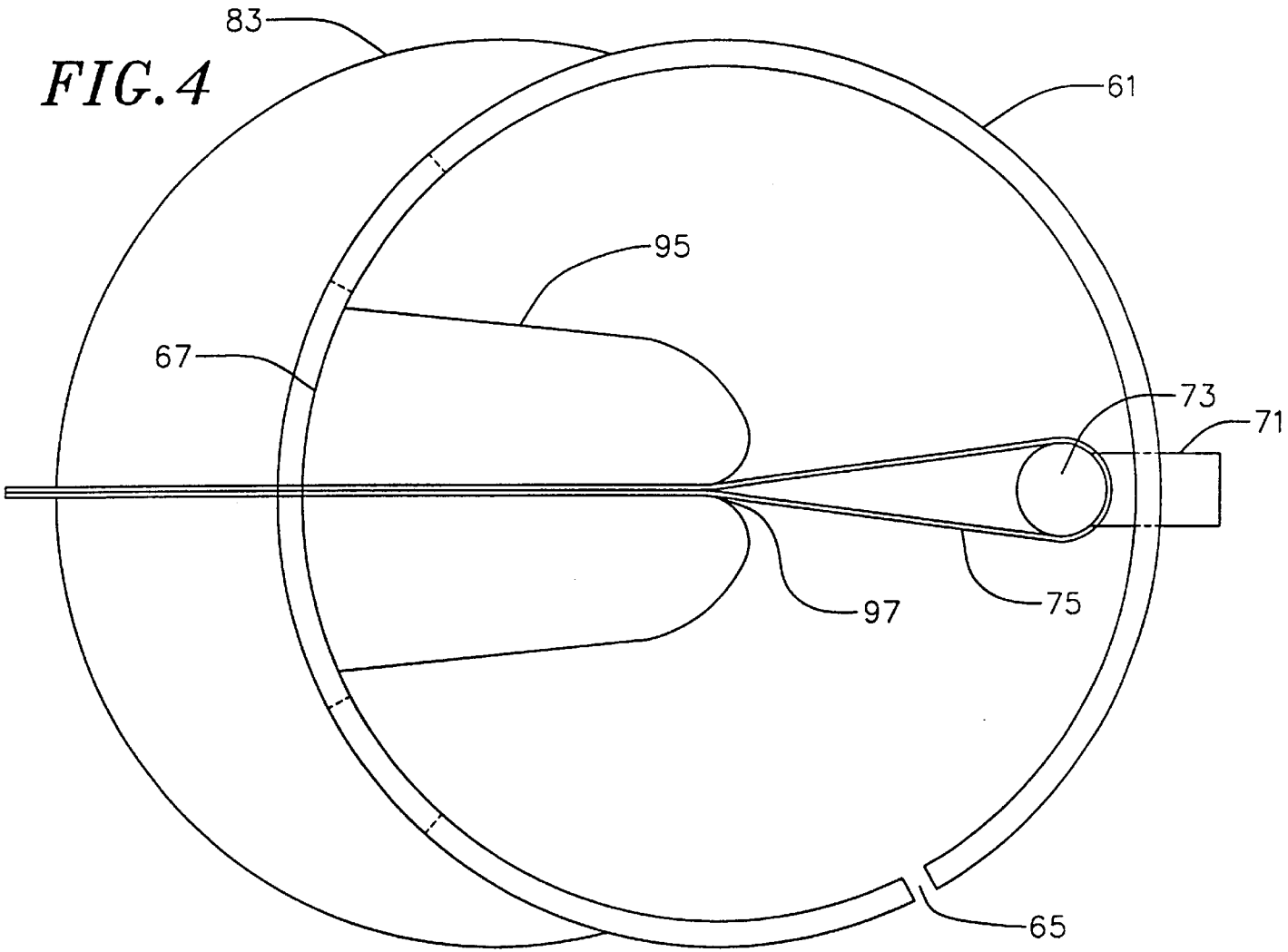
FIG. 4 illustrates a side view of the base cylinder of FIG. 3 and a partial cylinder of the keyboard support mechanism of FIG. 1.

FIG. 4 illustrates a side view of the base cylinder, along with a partial cylinder mounted to the base cylinder. As mentioned with respect to FIG. 3, the base cylinder comprises a tube 61 with a lengthwise slot 65. Coupled to the base cylinder is a partial cylinder 83. Details of the partial cylinder are illustrated in FIGS. 5 and 6.

Figure 5:
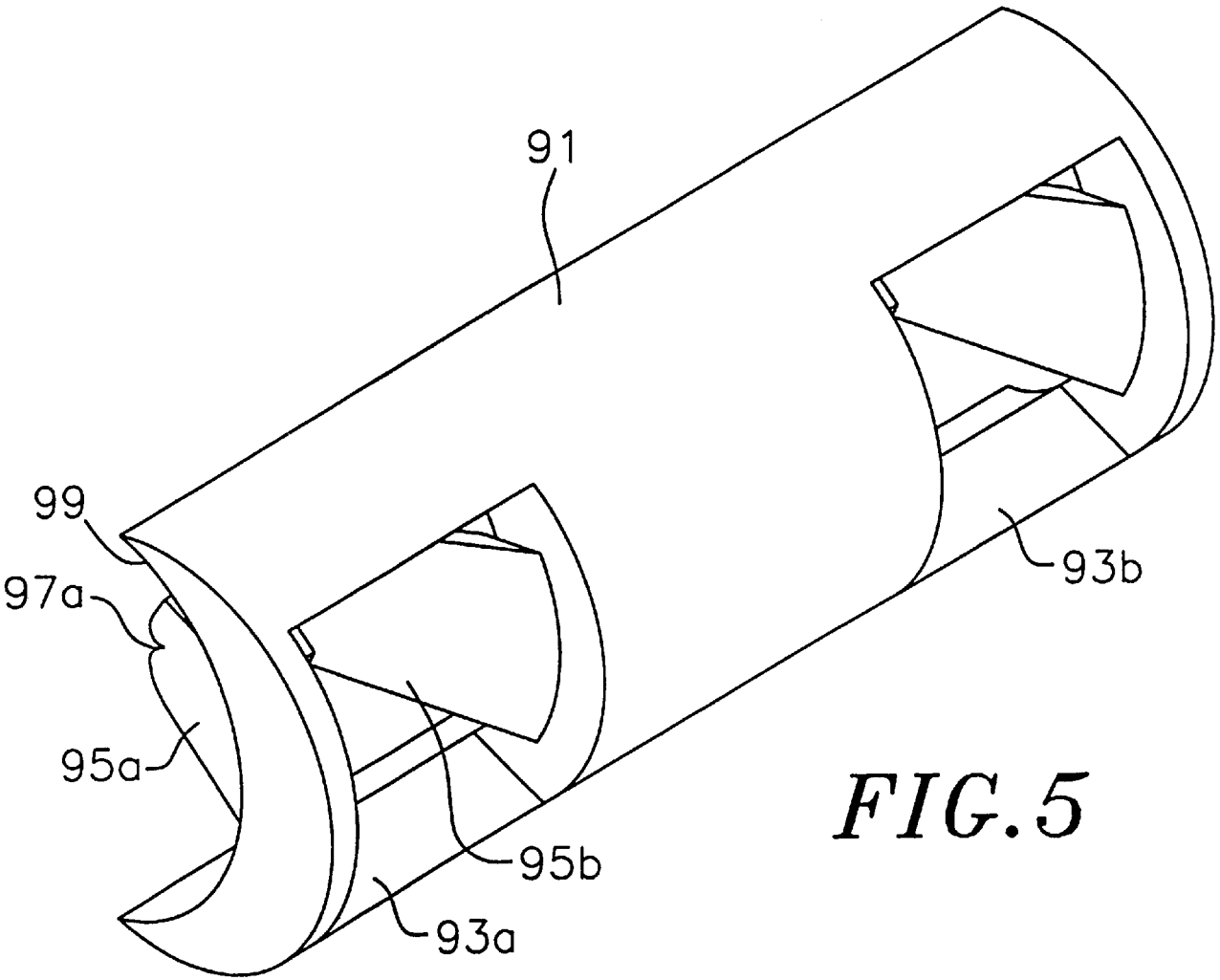
FIG. 5 illustrates a perspective view of the partial cylinder of FIG. 4.
Figure 6:
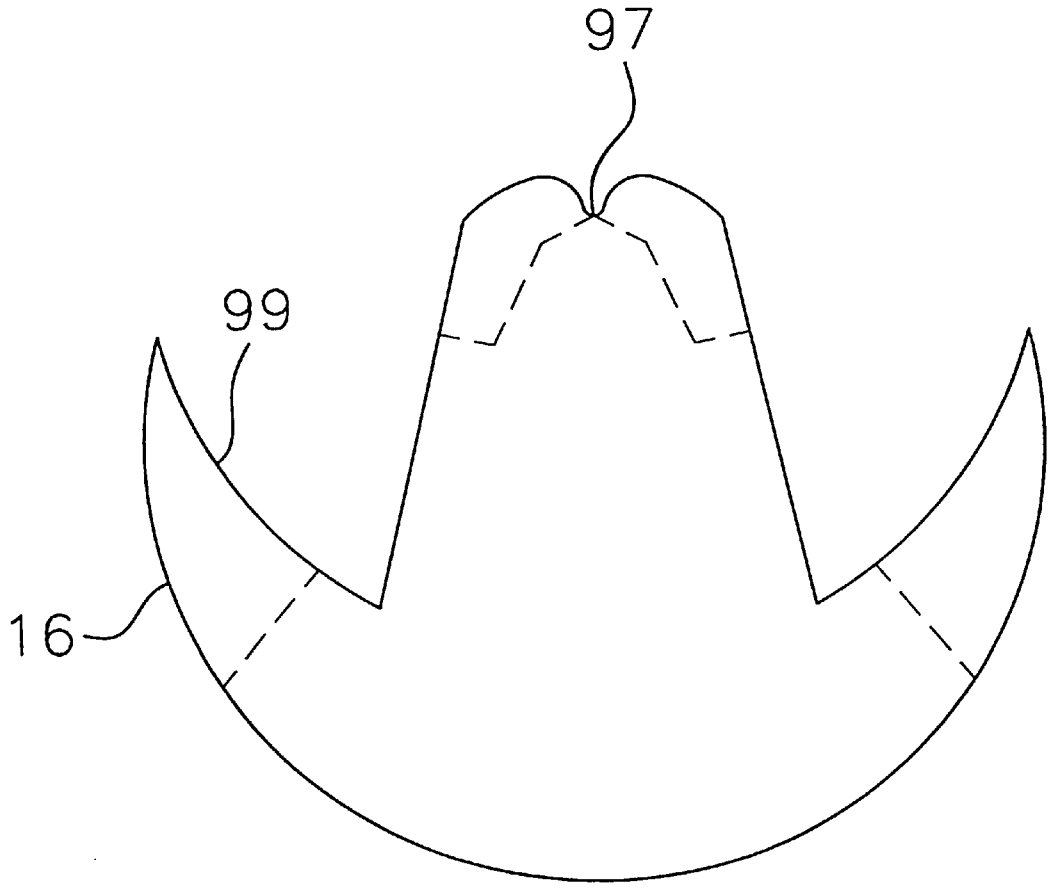
FIG. 6 illustrates a side view of the partial cylinder of FIG. 4.

As illustrated in FIG. 5, the partial cylinder has an inner surface 99 of the same radius as the base cylinder, and an outer surface 91 of substantially the same radius, but with a different center. The inner and outer surfaces meet to form upper and lower edges of the partial cylinders. Accordingly, the outer surface 91 forms a shape of a cylindrical crescent, with a cylindrical cutout outlined by the inner surface 99. Thus, the inner surface is adapted to mate with the base cylinder, and allows the partial cylinder to rotate around the base cylinder about the axis defined by the base cylinder.

The rotation of the partial cylinder, however, is constrained by roughly V-shaped supports extending from the inner surface of the partial cylinder in conjunction with the cross-shaped cutouts in the base cylinder. As may be seen in FIG. 5, the partial cylinder includes rectangular openings 93*a,b* approximate the ends of the cylinder. Extending from the inner surface of the partial cylinder, and more specifically the sides of the rectangular openings, are sides 95*a,b* of the V-shaped supports. The sides are joined by a base. The base includes a slot opening 97*a*. The slot opening is substantially parallel to the length of the partial cylinder. The slot opening allows for passage of the metal ribbon through the base of the V-shaped support, and thereafter through the rectangular opening.

Returning now to FIG. 4, the V-shaped supports 95 extend through the cross-shaped openings into the center of the tube. The widest portions of the cross-shaped opening are dimensioned so as to receive the V-shaped supports. When the inner surface of the partial cylinder is adjacent the base cylinder, however, the widest portions of the cross-shaped openings are of such dimension that the partial cylinder is largely fixed in position with respect to the base cylinder. Accordingly, the partial cylinder mated to the base cylinder is largely fixed in position.

Mounted within the tube is a mounting post 73. The mounting post is a cylindrical bar mounted parallel to an axis defined by the tube. The midpoint of the mounting post includes a threaded aperture (not shown), adapted to receive a set screw 71. The set screw passes through a screw hole in the tube, and then through the threaded aperture in the mounting post. Thus, the mounting post is mounted to the tube by means of the set screw 71. Adjustment of the set screw allows the mounting post to be moved closer or further from the axis defined by the tube.

Wrapped around the cylindrical areas of the mounting post, and approximate each end of the mounting post, are metal ribbons 75. The metal ribbons are approximately twice the length of the articulating arm and are therefore adapted to extend forward to the forward end of the articulating arm, and then to loop back to the mounting post. The metal ribbons extend through the slots 97 in the base of the V-shaped supports 95 in the series of partial cylinders. As described, tensioning of the metal ribbons places pressure against the outer surface of the cylindrical portion of the base cylinder causing the slot to decrease in size as the base cylinder is compressed. The set screw allows for adjustment of tension in the metal ribbons.

Figure 7:
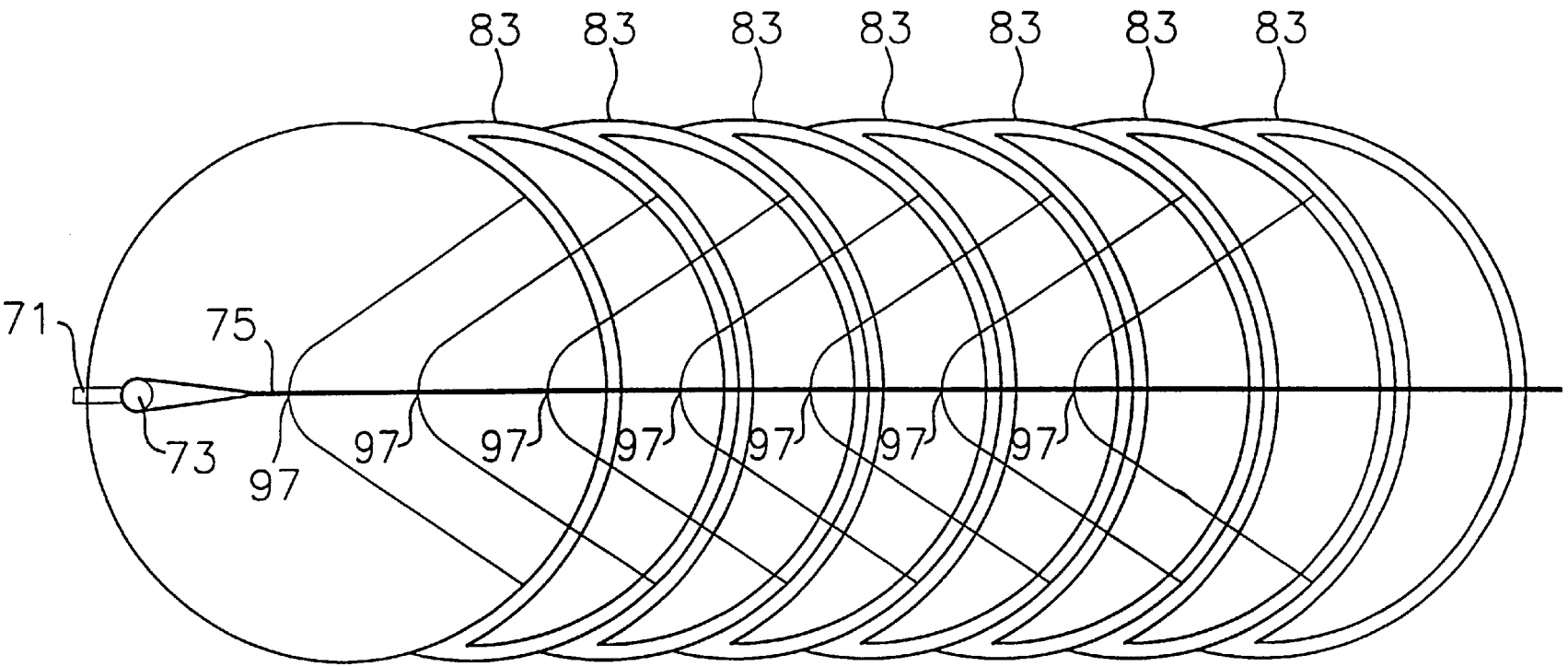
FIG. 7 illustrates a plurality of partial cylinders forming links in an articulating support mechanism.

As may be viewed in FIGS. 5 and 6, the shape of the V-shaped support and the rectangular cutouts of the partial cylinders 83 are such that each V passes through the rectangular opening of the prior links in the arm formed by the prior partial cylinders in the series. Thus, and as is illustrated in FIG. 7, a plurality of partial cylinders 83 are nested one within another. This nesting allows the inner surface of the partial cylinders to slide with respect to the outer surface of the prior partial cylinder in the series. The rotation of partial cylinders with respect to one another, however, is bounded by the dimension of the rectangular openings, thereby ensuring a smooth transition between links in the support arm.

In addition, the slot openings 97 of the V-shaped supports are each positioned at the center point of the partial circles formed by the outer surfaces of the partial cylinders. The slots form a constraint on the motion of the metal ribbon, and the metal ribbon therefore is caused to pass through each of the center points of the outer surfaces. As the center points remain equidistant from each other the length of travel of the metal ribbon remains substantially constant as the keyboard tray position is changed.

Figure 8:
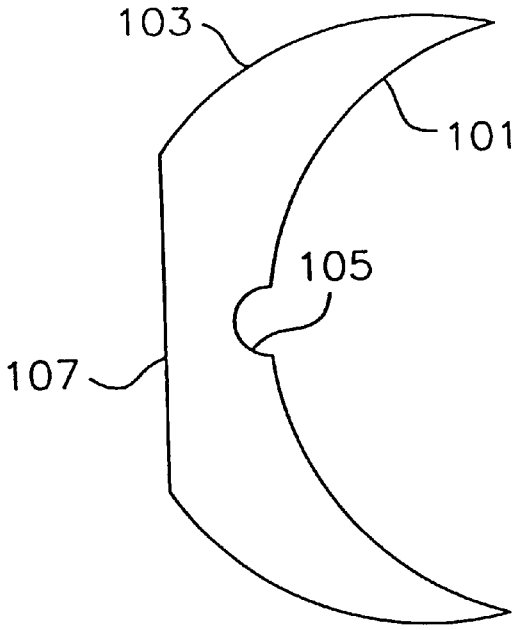
FIG. 8 illustrates an end piece of the keyboard support mechanism of FIG. 1.

The series of links in the support arm is, in the embodiment of FIG. 1, terminated by the end piece. An alternative embodiment, discussed below with respect to FIGS. 16 and 17, does not utilize the end piece. A side view of the end piece is illustrated in FIG. 8. The end piece is similarly shaped to the partial cylinders. Thus, the end piece includes an inner surface, 101 and an outer surface 103. The end piece does not, however, include the V-shaped supports. Instead, the end piece has a lengthwise groove 105 along its inner surface, and a flat surface 107 along its outer surface. The groove is adapted to receive a tensioning bar used to place the metal ribbon under tension. The flat surface is adapted to receive an L-bracket to allow for attachment of a keyboard tray, although brackets other than an L-bracket may be used.

Figure 9:
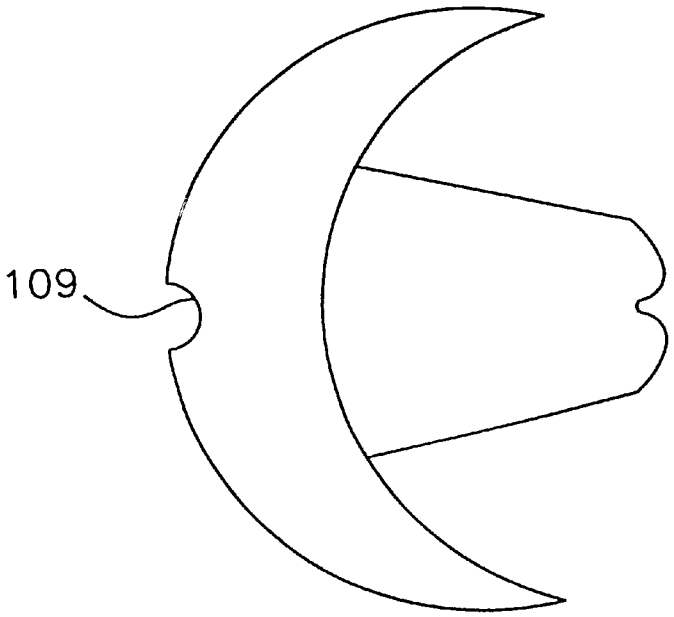
FIG. 9 illustrates a partial cylinder adapted to be placed adjacent the end piece of FIG. 8.

FIG. 9 illustrates the partial cylinder to which the end piece is coupled. This partial cylinder also contains a groove. The groove of this partial cylinder is lengthwise midway along its outer surface. Thus, a channel is formed between the end piece and prior partial cylinder when they are mated. The channel is adapted to receive the tensioning bar. In alternative embodiments, however, a lengthwise aperture is created in the end piece, and the tensioning bar passed through the aperture. This allows the partial cylinders to all be identical, thereby reducing the number of different parts required for the assembly.

Figure 10:
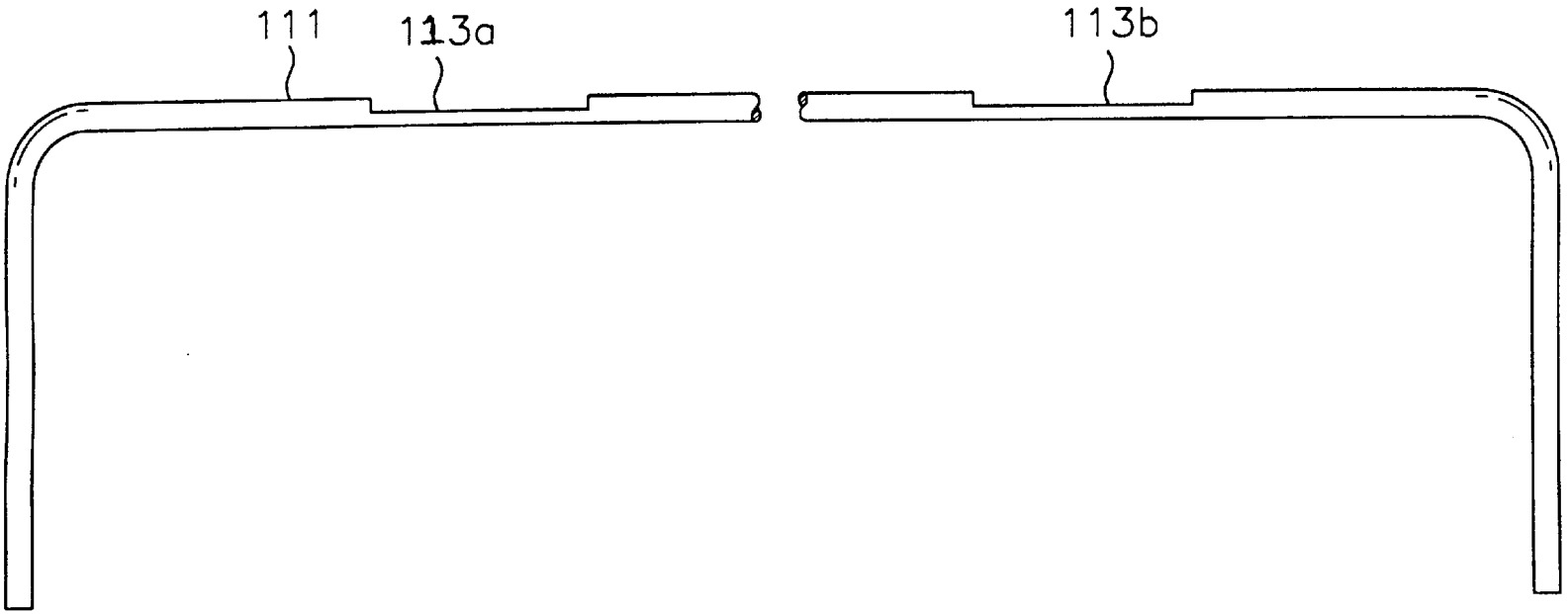
FIG. 10 illustrates a tensioning bar of the articulating keyboard support mechanism of FIG. 1.

The tensioning bar is illustrated in FIG. 10. The tensioning bar includes a central bar 111 having two eccentric portions 113a,b. When the central bar is positioned in the channel, the two eccentric portions are adjacent the rectangular openings of the partial cylinder coupled to the end piece.

As the positioning lever is moved the eccentric portions of the tensioning bar are rotated so as to rotate the eccentric portions. This causes the metal ribbon to undergo increased strain due to the increased distance between the forward edge of the tensioning bar and the rearward edge of the mounting cylinder. In turn, the increased strain on the metal ribbon results in the inner surface of each of the links of the partial cylinders to press tightly against the outer surface of the preceding link in the chain. This results in increased friction between each link in the chain, thereby holding the articulating arm in position. In addition, this tension, as previously mentioned, results in compression of the base cylinder and the narrowing of the slot therein, thereby inducing frictional forces within the base cylinder against the inset portion of the end cap. In sum, the increased tension in the metal ribbon serves to lock the articulating arm in position. Once so locked into position a keyboard placed on top of the keyboard tray may be conveniently used by a user in a comfortable manner.

Figure 11:
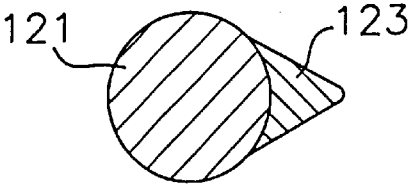
FIG. 11 illustrates a cross-sectional side view of an alternative tensioning bar.

FIG. 11 illustrates a cross section of the tensioning bar in an alternative embodiment. The tensioning bar comprises a central bar 121. Extending from one side of the bar, preferably the portion of the bar facing the partial cylinder with a groove in its outer surface, is additional material 123. Rotation of the tensioning bar increases the effective distance traveled by the metal ribbon, thereby providing tension to the metal ribbon and locking the partial cylinders in position. The additional material does not interfere with the coupling of the end piece and the partial cylinder as the additional material is only located along the tensioning bar in positions adjacent the rectangular cutouts of the partial cylinder. Thus, the additional material is free to move within the angles formed by the walls of the inner surface of the end piece.

In one alternative embodiment, however, no tensioning bar is provided to lock the articulating arm into position. Instead the tension in the metal ribbon is adjusted, by example using the set screw, to provide a relatively high level of tension at all times. This allows the articulating arm to be positioned by applying force to the arm, yet have the arm remain sufficiently stable for keyboard use.

Figure 12:
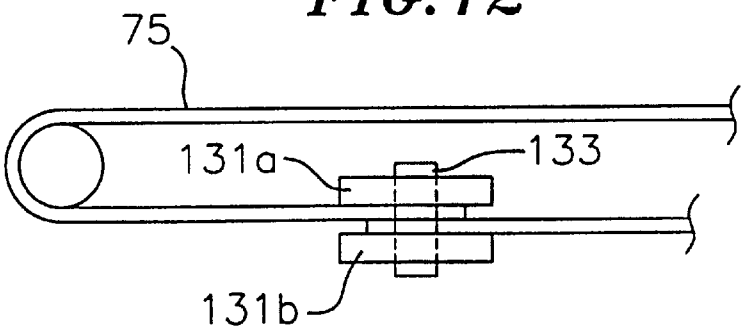
FIG. 12 illustrates a mechanism for joining the ends of a metal ribbon used in the keyboard support mechanism of FIG. 1.

FIG. 12 illustrates the coupling of the ends of the metal ribbon to form a continuous circular strip of the metal ribbon. As discussed previously, the metal ribbon wraps around a section of the tensioning bar, as well as a section of the mounting bar. Accordingly, some means of attaching the ends of the metal ribbon is necessary. As illustrated in FIG. 12, the ends of the metal ribbon are placed between two metal plates 131*a,b* having substantially the same width as the metal ribbon. The two plates are coupled together via rivets, screws or the like 133 so as securely hold the metal ribbon in place. Preferably, the ends of the metal ribbon include apertures adapted to receive the screws, thereby increasing the strength of the bond holding the ends of the metal ribbon together.

In an alternative embodiment, the metal ribbon is formed of a continuous band, or loop, and in other embodiments the metal band is weldably joined together. In other alternative embodiments, a metal grip wraps around the tensioning bar, with members extending rearward through the rectangular openings in the partial cylinder. The ends of the metal ribbon are affixed between members and as the tension bar rotates, rotation of the metal grip is also thereby, which thereby induces tension in the metal ribbon. Other methods of attaching into the metal ribbon, however, such as by glue or otherwise, are also well known in the art.

Figure 16:
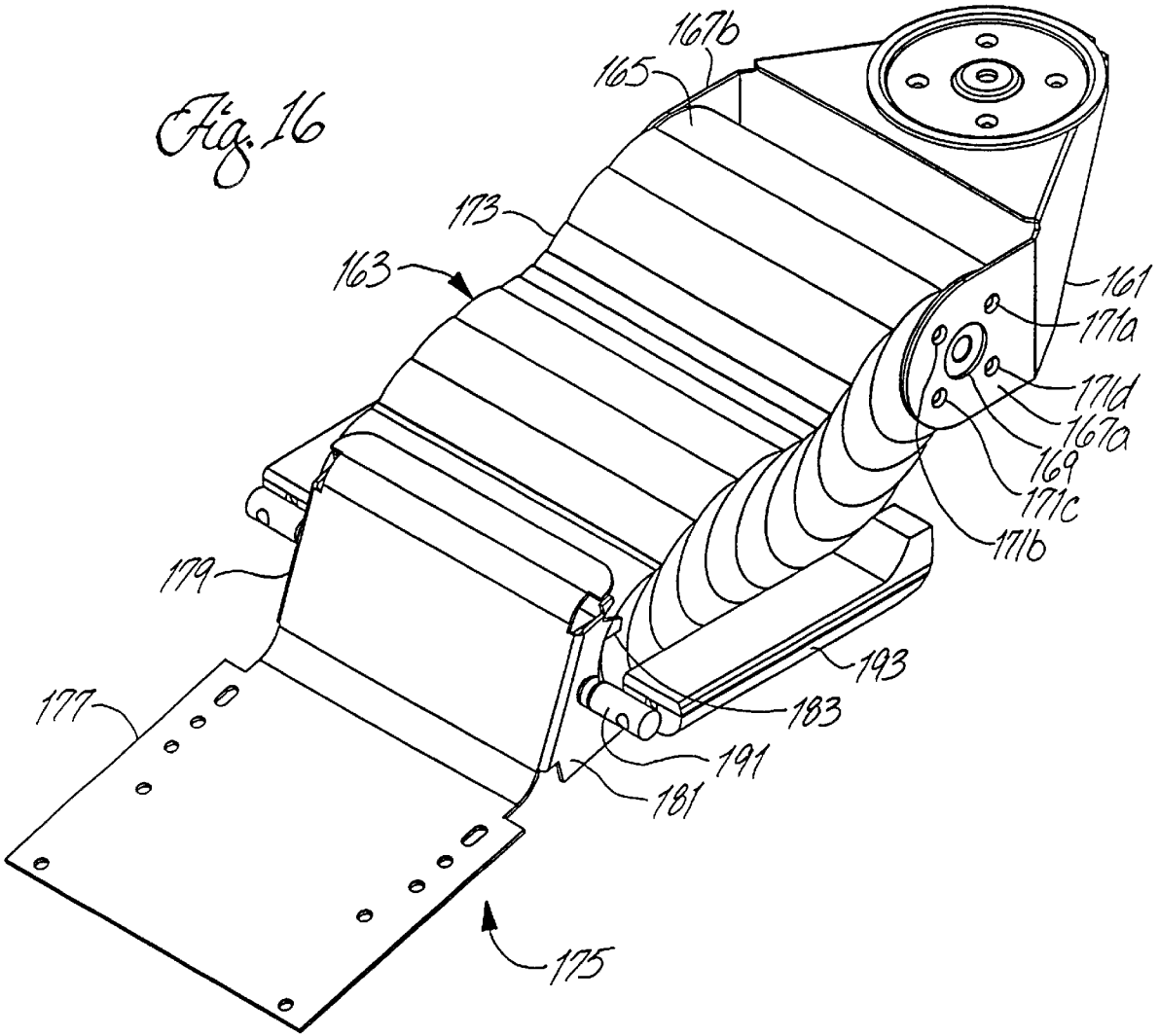
FIG. 16 illustrates a perspective view of an articulating keyboard support with an alternative tray support mount.

FIG. 16 illustrates an alternate embodiment of a keyboard support mechanism of the present invention. As previously mentioned, the alternate embodiment of FIG. 16 does not utilize a specialize end piece of the articulating arm. In some detail, in the embodiment illustrated in FIG. 16, an articulating arm 163 is coupled to a mounting bracket 161. A base cylinder 165 of the articulating arm is mounted between opposing arms 167*a,b* of the mounting bracket. The ends of the base cylinder includes a raised central portion for insertion in a large center opening 169 of the opposing arm. The ends of the base cylinder also includes screw holes to receive screws placed through screw holes 171*a–d* of the mounting bracket. This allows secure attachment of the base cylinder to the opposing arms.

Mounted to the side of the base cylinder is a series of partial cylinders 173 with cylindrical cut outs. The partial cylinders form links in the articulating arm. Coupled to the last of the partial cylinders in the series is a keyboard support tray 175.

The keyboard support tray includes a substantially flat base 177 to which a keyboard tray may be mounted. In alternative embodiments the support tray has a shaped or gussetted base. A sloping back plate 179 extends at an angle vertically from a rear of the base plate. Opposing brackets 181 extend opposite from the base plate from the back plate. The brackets include extending tabs which index into rectangular openings, such as may be seen in FIG. 5, of the partial cylinders. The brackets also include an aperture (not shown) to receive a tensioning bar 191. Attached to the tensioning bar is a positioning lever 193.

Figure 17:
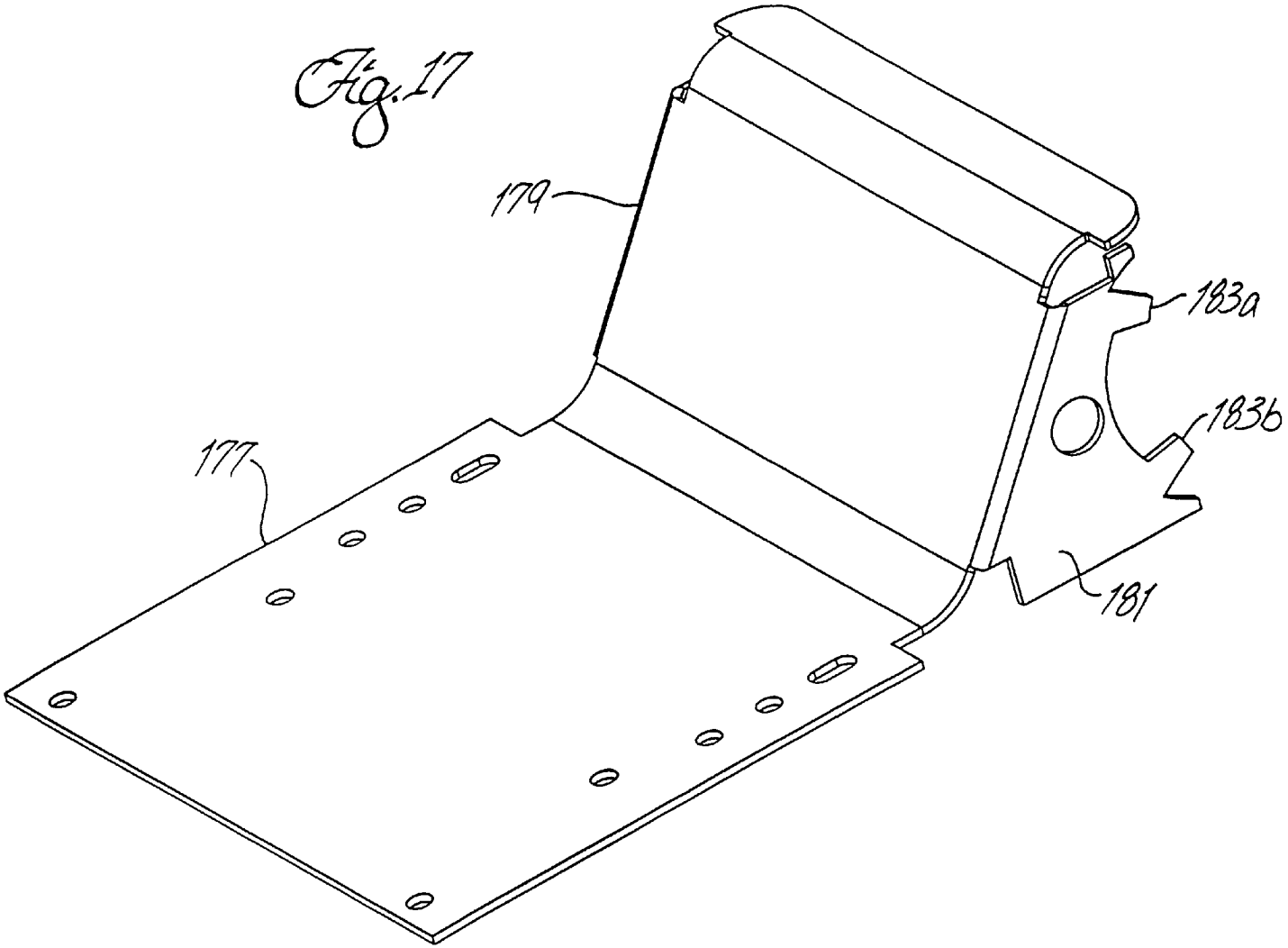
FIG. 17 illustrates a perspective view of the alternative tray support mount of FIG. 16.

FIG. 16 illustrates further details of the keyboard support tray. The keyboard support tray of FIG. 17 is a unitarily formed metal bracket. As indicated with respect to FIG. 16, the unitarily formed metal bracket includes a base plate 177 with a sloping back plate 179 extending rearward from the base plate. Two brackets 181 extend from the sloping base plate. The mounting brackets each include two tabs 183*a*, 183*b*. The tabs extend from a circular rear portion of the mounting bracket. The tabs are positioned relative to one another and are of a size and shape to be adapted to fit within the rectangular cut outs illustrated in FIG. 5. More specifically, the tabs are adapted to fit within the rectangular cut out, but on opposing sides of the V-shaped support. The tabs, along with the circular rear portion of the bracket therefore fits snugly against the last partial cylinder in the series. Thus, the embodiments of FIGS. 16 and 17 allow for the elimination of the end piece used in the embodiment of FIG. 1, and illustrated in FIG. 8. In addition, the penultimate end piece, with the slotted groove as illustrated in FIG. 9, is also not required as the tensioning bar is mounted within the mounting bracket.

Figure 13:
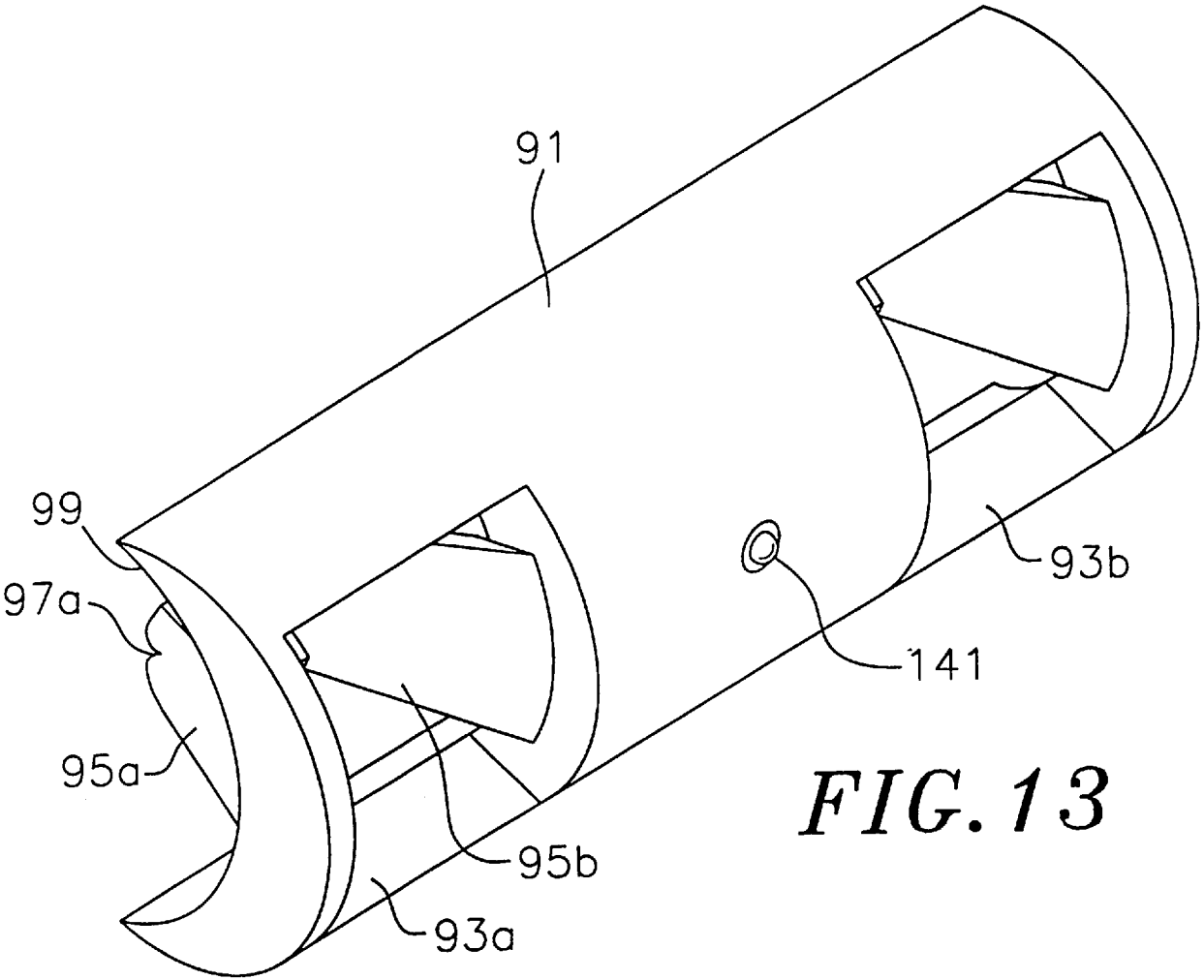
FIG. 13 illustrates an alternative partial cylinder having a spring loaded ball bearing.

FIG. 13 illustrates an alternative embodiment of a partial cylinder. In the alternative embodiment a spring loaded bearing is mounted on the outer surface of the partial cylinder. The spring loaded bearing 141 is located at the mid point of the outer surface of the partial cylinder. The spring loaded bearing causes slight displacement of the inner surface of the next partial cylinder in the series from the outer surface along which the spring loaded bearing is located. This allows adjacent partial cylinders to move more freely, and to reduce wear on the surfaces of the partial cylinders, due to the decreased area of contact between partial cylinders. Further, the spring loaded bearing performs this function when the inner surface, or the outer surface, is defined by ribs instead of a solid surface.

In an alternative embodiment multiple spring loaded ball bearings are used for each outer surface of each partial cylinder. For example, spring bearings in one embodiment are placed along the center line of the partial cylinder approximate the rectangular openings.

In a further alternative embodiment compressible rollers are mounted inset in small slots in the outer surface of the partial cylinders. Such rollers provide for a rolling, reduced friction interface between the partial cylinders when the position of the arm is adjusted, yet are forced inward in the slots when the metal ribbon induces compression in the arm.

In yet a further alternative embodiment the partial cylinders have surfaces which are non-uniform, i.e. non-smooth. For example, in one embodiment the inner and outer surfaces of the partial cylinders are rough or serrated or toothed. The non-smooth surfaces of the partial cylinders provides an increased frictional contact between partial cylinders for the same amount of tension in the metal ribbon, thereby allowing a keyboard attached to the articulating arm to support increased weight.

Figure 15:
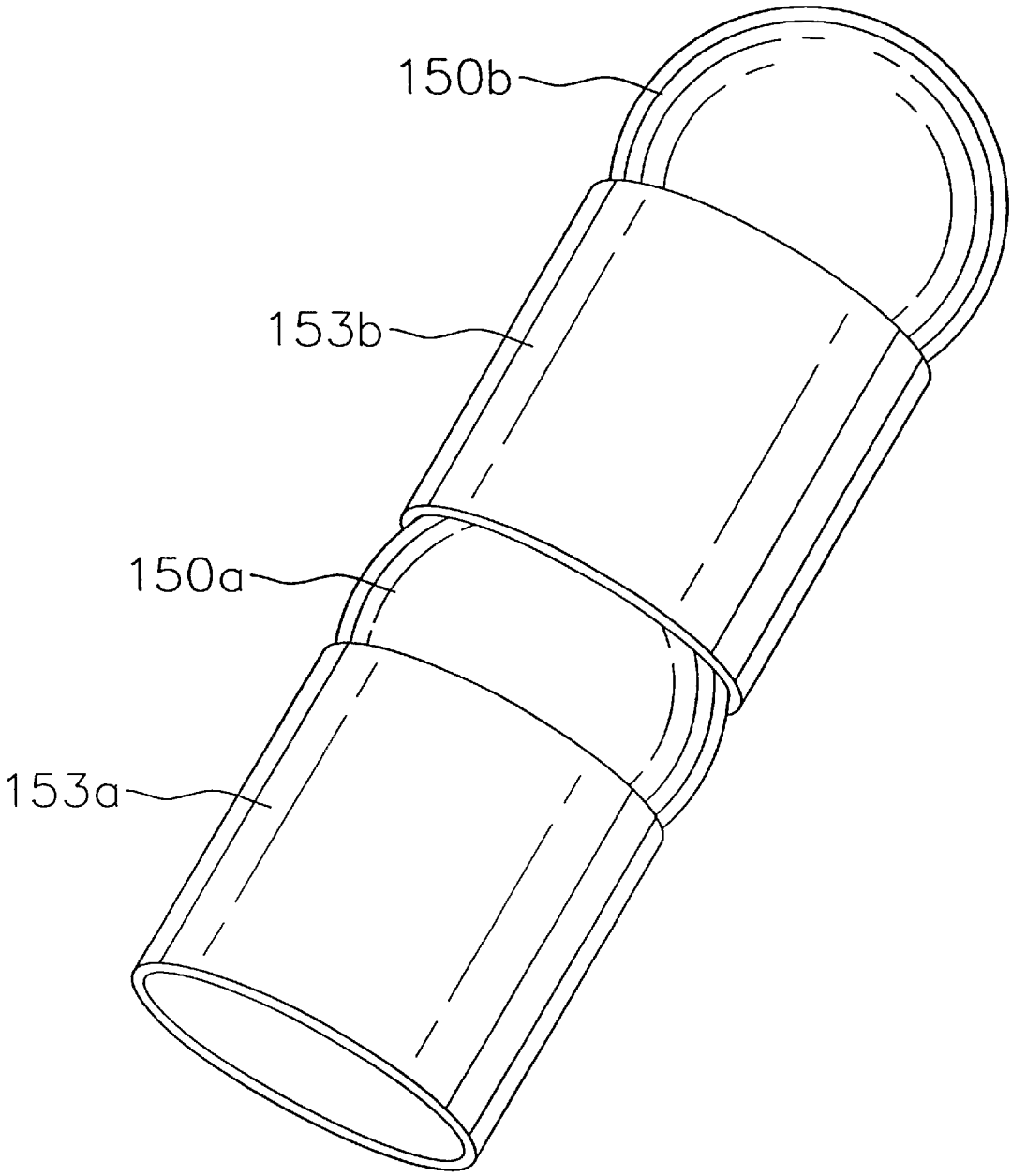
FIG. 15 illustrates a perspective view of some of the links of the alternative embodiment of FIG. 14.

FIG. 15 illustrates a perspective view of an alternative embodiment in which the links of the articulating arm are formed using a ball and socket mechanism. Thus, the arm includes members 153*a,b* having sockets at their ends. Balls 150*a,b* are placed in the sockets, and thereby couple the members together. The members are moveable through a number of angles through ball and socket motion.

Figure 14:
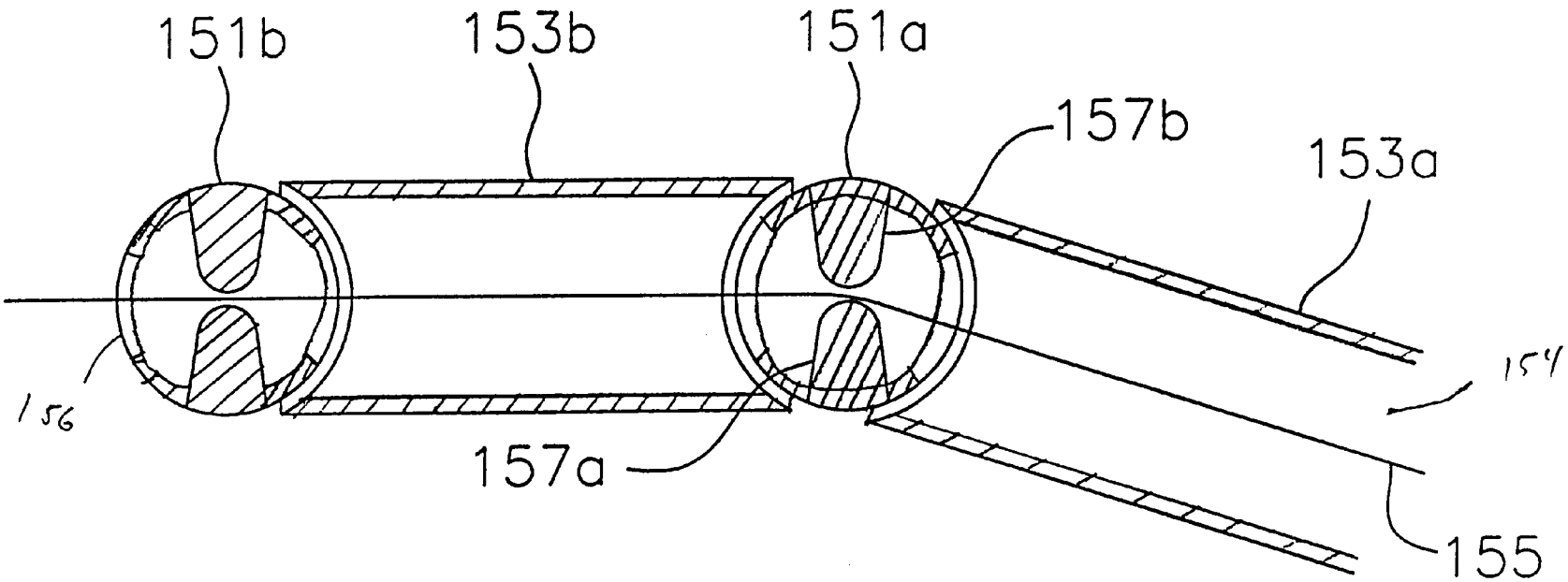
FIG. 14 illustrates a cross-section of an alternative embodiment of the present invention in which the links are formed using a ball and socket approach.

FIG. 14 illustrates a cross section of the embodiment of FIG. 15. As illustrated in FIG. 15 the members include a central hole 154 through which is passed a metal ribbon 155. In alternative embodiments, however, the metal ribbon is replaced with a cable. The metal ribbon also passes through apertures 156 in the balls. Included within the center of the balls are a pair of supports 157*a,b*. The supports define a slot at the center of the ball through which passes the metal ribbon. In one alternative embodiment, which is particularly suited for use with a cable, the supports join so as to form an aperture constraining movement of the cable to always remain at the center of the ball such that the members may be moved at angles in different planes with respect to one another. This therefore allows three-dimensional movement of the keyboard tray, or other item, supported by the articulating arm.

Accordingly, the present invention provides an articulating keyboard support arm. Although this invention has been described in certain specific embodiments, many additional modifications and variations would be apparent to those skilled in the art. It is therefore to be understood that this invention may be practiced otherwise than as specifically described. Thus, the present embodiments of the invention should be considered as illustrative and not restrictive, the scope of the invention to be indicated by the claims and their equivalents supported by this application rather than the foregoing description.

What is claimed is:

1. A keyboard tray support device comprising:

a bracket adapted for mounting to an underside of a desktop;

an arm comprised of a plurality of links coupled in series, a first end of the arm being coupled to the bracket and second end of the arm being coupled to a keyboard tray; and means to press together adjacent links so as to substantially fix the position of the adjacent links with respect to each other.

2. A keyboard tray support device comprising:

a bracket adapted for mounting to an underside of a desktop;

an arm comprised of a plurality of links coupled in series, a first end of the arm being coupled to the bracket and second end of the arm being coupled to a keyboard tray;

means to increase the friction between adjacent links so as to substantially fix the position of the adjacent links with respect to each other; and wherein the means to increase friction between adjacent links comprises a cable coupled to a first link at a first point and a second link at a second point, and means to change the distance between the first poi nit and the second point.

3. The keyboard tray support device of claim 2 wherein the means to change the distance between the first point and the second point comprises a camming mechanism.

4. The keyboard tray support device of claim 3 wherein the bracket includes slides adapted for mounting to the underside of the desktop.

5. The keyboard tray support device of claim 4 wherein the plurality of links include curved surfaces having substantially similar curvatures.

6. The keyboard tray support device of claim 5 wherein adjacent links have curved surfaces having substantially similar curvatures substantially in contact.

7. The keyboard tray support device of claim 6 wherein the plurality of links are coupled to the bracket by a base piece.

8. The keyboard tray support device of claim 7 wherein the plurality of links are coupled to the keyboard tray by an end piece.

9. The keyboard tray support device of claim 8 wherein the first link is the base piece and the second link is the end piece.

10. The keyboard tray support device of claim 9 wherein the cable comprises a metal ribbon, the first point is formed by a first bar and the second point is formed by a second bar, with the first bar translationaly moveable with respect to the second bar.

11. The keyboard tray support device of claim 10 wherein the second bar includes a cam.

12. The keyboard tray support device of claim 11 wherein the plurality of links are substantially cylindrically shaped.

13. The keyboard tray support device of claim 12 wherein the base piece comprises a tube having a lengthwise slot.

14. An articulating keyboard support comprising:

a keyboard tray;

an articulating arm having a plurality of links coupled in series, with a first end coupled to the keyboard tray and a second end coupled to a bracket, the bracket being adapted to be coupled to an underside of a desktop;

wherein the links have a substantially crescent shaped cross-section;

wherein the links have two sides connected by a length having an outer surface and an inner surface, the sides being substantially crescent shaped and the outer surface and the inner surface have substantially the same curvature;

wherein the links include an aperture extending from the outer surface to the inner surface; and wherein the links are coupled by a cable.

15. The articulating keyboard support of claim 14 wherein the links include a support extending away from the inner surface, the support including an aperture receiving the cable.

16. The articulating keyboard support of claim 15 wherein the aperture is located at a center point of a partial circle defined by the outer surface.

17. The articulating keyboard support of claim 16 wherein the cable is a metal ribbon and the aperture is a slot.

18. The articulating keyboard support of claim 1 wherein the links include a plurality of members having sockets and at least one ball interposed between the sockets of at least two members.

19. The articulating keyboard support of claim 18 wherein the links are coupled by a cable.

20. The articulating keyboard support of claim 19 wherein the links include a support extending away from the inner surface, the support including an aperture receiving the cable.

21. The articulating keyboard support of claim 20 wherein the aperture is located at a centerpoint of the ball.

22. A keyboard tray support device comprising:

a bracket adapted for mounting to an underside of a desktop;

an arm comprised of a plurality of links coupled in series, a first end of the arm being coupled to the bracket and second end of the arm being coupled to a keyboard tray; and means to increase the friction between adjacent links so as to substantially fix the position of the adjacent links with respect to each other; and at least one brake shoe coupled to a link forming the first end of the arm, the brake shoe serving to fix the position of the link forming the first end of the arm with respect to the bracket.

* * * * *

UNITED STATES PATENT AND TRADEMARK OFFICE

CERTIFICATE OF CORRECTION

PATENT NO. : 6,481,683 B1 
DATED : November 19, 2002
INVENTOR(S) : Kristin M. Stewart et al.

It is certified that error appears in the above-identified patent and that said Letters Patent is hereby corrected as shown below:

Title page,
Item [73], Assignee, delete the comma (,) after "International" to read:
-- Accuride International Inc. --

Column 9,
Line 7, "poi nit" should be -- point --.

Signed and Sealed this

Twelfth Day of August, 2003

JAMES E. ROGAN
*Director of the United States Patent and Trademark Office*